US011829171B1

(12) United States Patent
Abbasi

(10) Patent No.: US 11,829,171 B1
(45) Date of Patent: Nov. 28, 2023

(54) BANDGAP MODULE AND LINEAR REGULATOR

(71) Applicant: Key ASIC Inc., Hsinchu County (TW)

(72) Inventor: Shahbaz Abbasi, Hsinchu County (TW)

(73) Assignee: KEY ASIC INC., Hsinchu County (TW)

( * ) Notice: Subject to any disclaimer, the term of this patent is extended or adjusted under 35 U.S.C. 154(b) by 8 days.

(21) Appl. No.: 17/844,124

(22) Filed: Jun. 20, 2022

(51) Int. Cl.
*G05F 1/46* (2006.01)
*G05F 3/26* (2006.01)

(52) U.S. Cl.
CPC ..... *G05F 1/468* (2013.01); *G05F 1/461* (2013.01); *G05F 3/267* (2013.01)

(58) Field of Classification Search
CPC ..... G05F 1/461; G05F 1/468; G05F 3/267
See application file for complete search history.

(56) References Cited

U.S. PATENT DOCUMENTS

| | | | | |
|---|---|---|---|---|
| 10,061,340 | B1 * | 8/2018 | Rao | G05F 3/267 |
| 10,222,817 | B1 * | 3/2019 | Deng | H03L 3/00 |
| 2016/0091916 | A1 * | 3/2016 | Chang | G05F 3/262 323/268 |
| 2017/0012609 | A1 * | 1/2017 | Shen | G05F 3/267 |
| 2022/0253087 | A1 * | 8/2022 | Gupta | G05F 1/575 |

* cited by examiner

*Primary Examiner* — Jue Zhang
*Assistant Examiner* — Lakaisha Jackson
(74) *Attorney, Agent, or Firm* — WPAT, P.C

(57) ABSTRACT

A bandgap module and a linear regulator are provided. The linear regulator includes the bandgap module and an error amplifier. The voltage supply voltage includes a bandgap circuit, a lowpass filter, and a start-up module. The voltage supply voltage generates a bandgap voltage. The lowpass filter filters the bandgap voltage and generates a reference voltage accordingly. The start-up module includes a first start-up circuit and a second start-up circuit. The bandgap voltage is increased to a predefined value when the bandgap module operates in a first phase. The bandgap voltage maintains at the predefined value when the bandgap module operates in a second phase. The second phase is after the first phase.

20 Claims, 6 Drawing Sheets

BANDGAP MODULE AND LINEAR REGULATOR

FIELD OF THE INVENTION

The present invention relates to a bandgap module and a linear regulator, and more particularly to a bandgap module and a linear regulator consuming a low quiescent current, having low noise, and having a short start-up time.

BACKGROUND OF THE INVENTION

Portable electronic devices are widely used, and a battery is necessary for portable electronic devices. The battery provides a supply voltage Vdd to a load circuit for operation. However, the supply voltage Vdd is not constant, and a linear regulator has been adopted to provide a stable regulated voltage Vreg to the load circuit.

FIG. 1A is a waveform diagram showing the supply voltage Vdd and the regulated voltage Vreg. The horizontal axis represents time. In FIG. 1A, a waveform WF1 represents the supply voltage Vdd output by a battery, and a waveform WF2 represents the regulated voltage Vreg output by a linear regulator.

The linear regulator is connected to the output of the battery, and the linear regulator regulates the supply voltage Vdd to generate the regulated voltage Vreg. In portable electronic devices such as Internet of things (hereinafter, IoT) devices, the battery is always equipped. As time passes, the waveform WF1 (supply voltage Vdd) continuously decreases, but the waveform WF2 (regulated voltage Vreg) maintains a certain value. Thus, the use of the linear regulator becomes a stable and consistent voltage source, and the linear regulator is critical in portable electronic devices.

FIG. 1B is a block diagram illustrating an electronic device using a linear regulator. The electronic device 10 includes a load circuit 15, a battery 11, and a linear regulator 13. The linear regulator 13 is electrically connected to the battery 11 and the load circuit 15. After receiving the supply voltage Vdd from the battery 21, the linear regulator 13 regulates the supply voltage Vdd and transmits the regulated voltage Vreg to the load circuit 23.

The linear regulator 13 is a low-dropout (hereinafter, LDO) linear regulator including a bandgap circuit 131, an error amplifier 133, a PMOS transistor Men, and branch resistors Ra, Rb. The source terminal and the gate terminal of the PMOS transistor Men are respectively electrically connected to the battery 11 and an output terminal of the error amplifier 33. The non-inverting input terminal (+) and the inverting input terminal (−) of the error amplifier 133 are respectively electrically connected to the bandgap circuit 131 and the branch resistors Ra, Rb. The branch resistors Ra, Rb are serially connected between the drain terminal of the PMOS transistor Men and a ground terminal Gnd. For the sake of representation, both the ground voltage and the ground terminal are represented as Gnd in the specification. The error amplifier 133 receives a reference voltage Vref from the bandgap circuit 131.

Based on the reference voltage Vref and the branch resistors Ra, Rb, the regulated voltage Vreg can be represented as $$Vreg = \left(1 + \frac{Ra}{Rb}\right) * Vref.$$

Therefore, precision, stability, and start-up speed of the reference voltage Vref influence the behavior of the regulated voltage Vreg.

SUMMARY OF THE INVENTION

Therefore, the present invention relates to a bandgap module and a linear regulator having a low quiescent current, low noise, and short start-up time.

An embodiment of the present invention provides a bandgap module. The bandgap module includes a bandgap circuit, a start-up module, and a lowpass filter. The bandgap circuit includes an operational amplifier, a current mirror, a first loading branch, a second loading branch, and a bandgap branch. The operational amplifier includes a first input terminal, a second input terminal, and a current control terminal. The current mirror is electrically connected to the first input terminal, the second input terminal, and the current control terminal. The current mirror generates a first loading current, a second loading current, and a mirrored current. The first loading, the second loading current, and the mirrored current are generated based on a signal at the current control terminal. The first loading current, the second loading current, and the mirrored current are equivalent. The first loading branch is electrically connected to the first input terminal, and the second loading branch is electrically connected to the second input terminal. The first loading branch receives the first loading current, and the second loading branch receives the second loading current. The bandgap branch is electrically connected to the current mirror. The bandgap branch receives the mirrored current and conducts a bandgap current. A bandgap voltage is generated based on the bandgap current. The start-up module includes a first start-up circuit and a second start-up circuit. The first start-up circuit is electrically connected to the bandgap circuit. The first start-up circuit accelerates the generation of the mirrored current so that the bandgap voltage is increased to a predefined value when the bandgap module operates in a first phase. The second start-up circuit is electrically connected to the bandgap circuit, the lowpass filter, and the first start-up circuit. The second start-up circuit conducts an additional current to the bandgap branch and maintains the bandgap voltage at the predefined value when the bandgap module operates in a second phase. The second phase is after the first phase. The lowpass filter is electrically connected to the bandgap circuit and the second start-up circuit. The lowpass filter filters the noise of the bandgap voltage and generates a reference voltage accordingly.

Another embodiment of the present invention provides a linear regulator. The linear regulator receives a supply voltage, and the linear regulator includes the bandgap module and an error amplifier. The error amplifier is electrically connected to the bandgap module. The error amplifier generates an error signal by comparing the reference voltage with a comparison voltage. A regulated voltage is generated based on the supply voltage and the error signal.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

For portable battery operated device applications such as IoT devices, the linear regular needs to have low-power, low-noise and short start-up time. In such devices, power consumption should be low to extend battery life, and the linear regulator needs low noise to ensure proper functionality of sensitive analog circuits. Usually IoT devices have to respond very fast to various events that the device is reporting and then transmit to the server, so the short start-up time is also an essential criteria.

The specification illustrates the embodiments of bandgap modules and LDO linear regulators with low quiescent current, low noise, and fast start-up time. The bandgap module receives the supply voltage Vdd and generates a constant reference voltage Vref accordingly. The reference voltage Vref is further utilized to generate a regulated voltage Vreg for the load circuit.

Figure 1A:
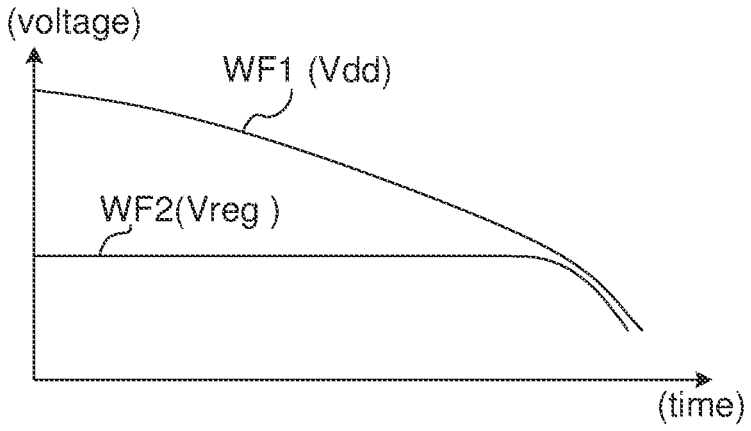
FIG. 1A (PRIOR ART)
FIG. 1A (prior art) is a waveform diagram showing the supply voltage Vdd and the regulated voltage Vreg.
Figure 1B:
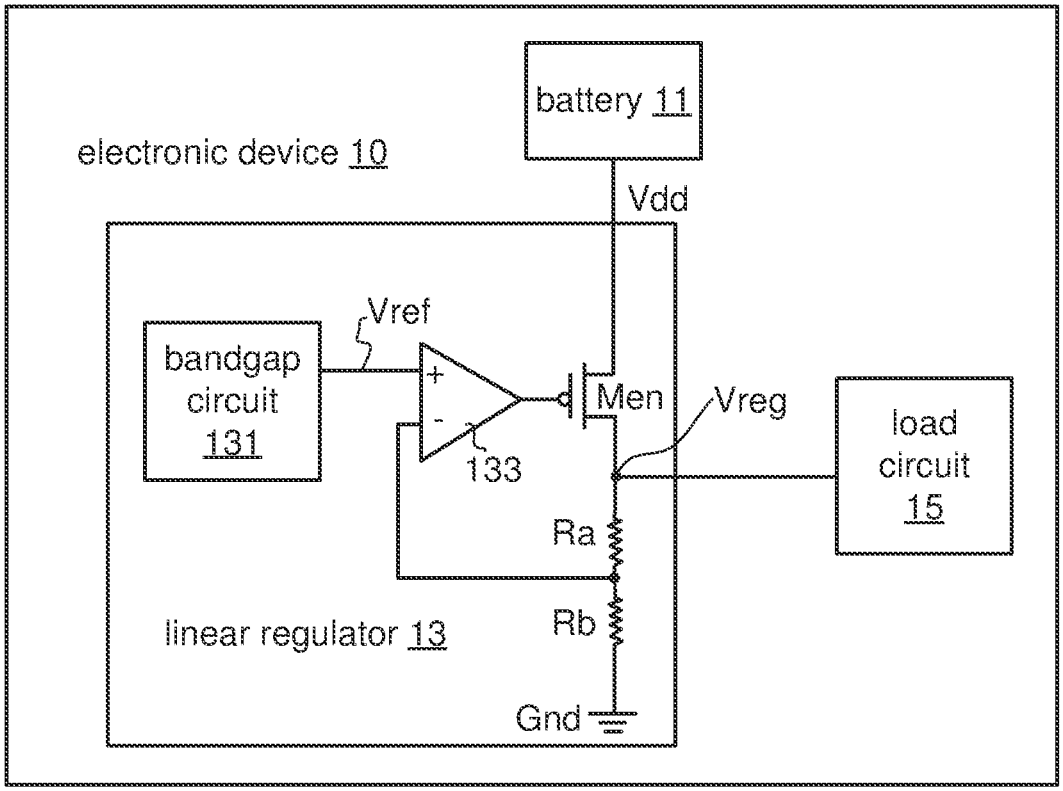
FIG. 1B (PRIOR ART)
FIG. 1B (prior art) is a block diagram illustrating an electronic device using a linear regulator.
Figure 2:
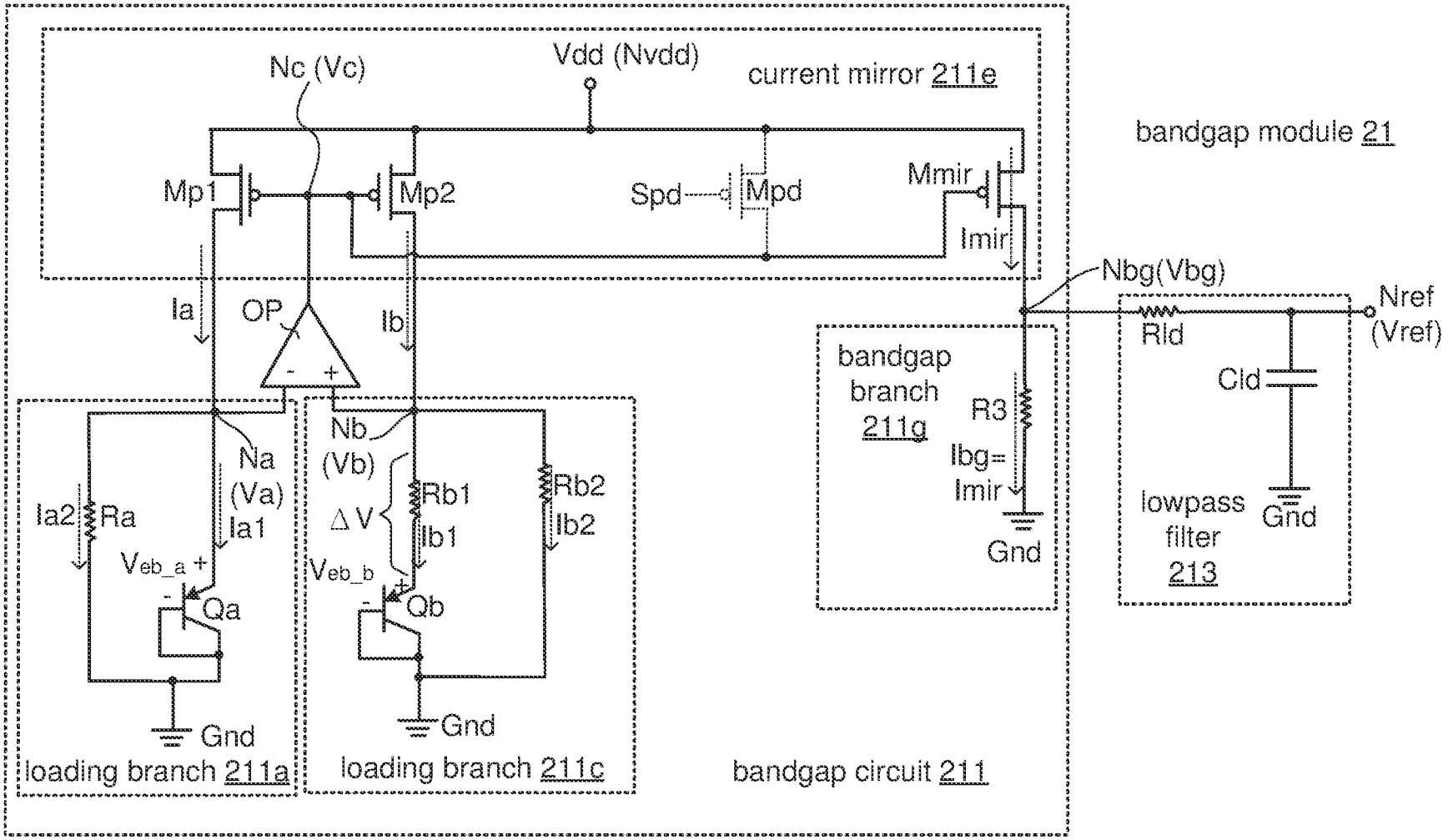
FIG. 2 is a schematic diagram illustrating a bandgap module according to an embodiment of the present disclosure.

FIG. 2 is a schematic diagram illustrating a bandgap module according to an embodiment of the present disclosure. The bandgap module 21 includes a bandgap circuit 211 and a lowpass filter 213, and both are electrically connected to a bandgap terminal Nbg.

The bandgap circuit 211 provides a constant bandgap voltage Vbg at the bandgap terminal Nbg, and the lowpass filter 213 filters out the noise at the bandgap voltage Vbg and outputs the reference voltage Vref at a reference terminal Nref.

Please note that, in some applications, the bandgap circuit 211 may include a power-down transistor Mpd to save power and extend battery life. The power-down transistor Mpd is electrically connected to the supply voltage terminal (Vdd) and a current control terminal Nc. The power-down transistor Mpd is controlled by a power-down signal Spd. When the electronic device is in a power-down mode or a sleep mode, the power-down transistor Mpd is switched on, and the supply voltage Vdd is conducted to the current control terminal Nc to disable the loading transistors Mp1, Mp2, and the mirror transistor Mmir. On the other hand, when the electronic device operates in a normal operation mode, the power-down transistor Mpd is switched off, and the bandgap circuit 211 operates normally. In the specification, the power-down signal Spd is assumed to be set to the logic high (Spd=H).

The bandgap circuit 211 includes a current mirror 211*e*, an operational amplifier OP, loading branches 211*a*, 211*c*, and a bandgap branch 211*g*. The current mirror 211*e* and the bandgap branch 211*g* are electrically connected to the bandgap terminal Nbg. The current mirror 211*e* and the loading branch 211*a* are electrically connected to a terminal Na (that is, the inverting input terminal (−) of the operational amplifier OP), and the current mirror 211*e* and the loading branch 211*c* are electrically connected to a terminal Nb (that is, the non-inverting input terminal (+) of the operational amplifier OP).

The current mirror 211*e* includes loading transistors Mp1, Mp2, and a mirror transistor Mmir. In the current mirror 211*e*, the loading transistors Mp1, Mp2, and the mirror transistor Mmir are PMOS transistors. The currents flowing through the loading transistors Mp1, Mp2 are respectively defined as loading currents Ia, Ib, and the current flowing through the mirror transistor Mmir is defined as a mirrored current Imir. It is assumed that the loading transistor Mp1, Mp2, and the mirror transistor Mmir have the same aspect ratio, so the current values of the loading currents Ia, Ib, and the mirrored current Imir are equivalent (Ia=Ib=Imir).

The loading branch 211*a* includes a transistor Qa and a branch resistor Ra, and the loading branch 211*c* includes a transistor Qb and branch resistors Rb1, Rb2. In the loading branch 211*a*, a branch current Ia1 flows through the transistor Qa, a branch current Ia2 flows through the branch resistor Ra, and the summation of the branch currents Ia1, Ia2 is equivalent to the loading current Ia. In the loading branch 211*c*, a branch current Ib1 flows through the transistor Qa and the branch resistor Rb1, a branch current Ib2 flows through the branch resistor Rb2, and the summation of the branch currents Ib1, Ib2 is equivalent to the loading current Ib.

The resistance values of the branch resistors Ra, Rb2 are equivalent. It is assumed that the transistors Qa, Qb are PNP-type bipolar junction transistors (BJT). In practical applications, the transistors Qa, Qb can be replaced with diodes.

The bandgap branch 211*g* includes a bandgap resistor R3. The bandgap resistor R3 is electrically connected to the bandgap terminal Nbg and the ground terminal Gnd, and a bandgap current Ibg flows through the bandgap resistor R3 to the ground terminal Gnd. In FIG. 2, the bandgap current Ibg is equivalent to the mirrored current Imir.

The gate terminals of the loading transistors Mp1, Mp2, and the mirror transistor Mmir are jointly electrically connected to a current control terminal Nc (that is, the output terminal of the operational amplifier OP), and the source terminals of the loading transistors Mp1, Mp2, and the mirror transistor Mmir are electrically connected to the supply voltage terminal Nvdd. The drain terminals of loading transistors Mp1, MP2, and the mirror transistor Mmir are respectively electrically connected to the terminal Na, the terminal Nb, and the bandgap terminal Nbg.

In the loading branch 211*a*, the base terminal (B) and the collector terminal (C) of the transistor Qa are electrically connected to the ground terminal Gnd. The emitter terminal (E) of the transistor Qa is electrically connected to the terminal Na. The resistor Ra is electrically connected to the terminal Na and the ground terminal Gnd. In the loading branch 211*c*, the base terminal (B) and the collector terminal (C) of the transistor Qb are electrically connected to the ground terminal Gnd. The branch resistor Rb1 is electrically connected to the terminal Nb and the emitter terminal (E) of the transistor Qb. The branch resistor Rb2 is electrically connected to the terminal Nb and the ground terminal Gnd.

Please refer to the loading branch 211*a*. The terminal voltage Va is equivalent to the emitter-base voltage difference $V_{eb_a}$ of the transistor Qa, wherein the terminal voltage Va is complementary to absolute temperature (hereinafter, CTAT). According to the current equation of the transistor Qa, the branch current Ia1 can be represented by equation (1).

$$Ia1 = Isa \cdot e^{\frac{V_{eb_a}}{V_T}} \quad \text{equation (1)}$$

The variable Isa represents the saturation current of the transistor Qa, and the variable $V_T$ represents a thermal voltage. Through the conduction of equation (1), the emitter-base voltage difference $V_{eb_a}$ of the transistor Qa can be obtained by equation (2).

$$V_{eb_a} = V_T \cdot \ln\left(\frac{Ia1}{Isa}\right) \quad \text{equation (2)}$$

On the other hand, the branch current Ia2 can be represented as $$Ia2 = \frac{Va}{Ra} = \frac{V_{eb_a}}{Ra}.$$

Please refer to the loading branch 211*c*. Similarly, the branch current Ib1 can be represented by equation (3), and the emitter-base voltage difference $V_{eb_b}$ of the transistor Qb can be represented by equation (4).

$$Ib1 = Isb \cdot e^{\frac{V_{eb_b}}{V_T}} \quad \text{equation (3)}$$

$$V_{eb_b} = V_T \cdot \ln\left(\frac{Ib1}{Isb}\right) \quad \text{equation (4)}$$

In equations (3) and (4), the variable Isb represents the saturation current of the transistor Qb. As the terminal voltages Va, Vb are equivalent, and the branch resistors Ra, Rb2 are equivalent, the branch current Ib2 can be represented as $$Ib2 = Ia2 = \frac{V_{eb_a}}{Ra} = \frac{V_T \cdot \ln\left(\frac{Ia1}{Isa}\right)}{Ra}.$$

As the emitter-base voltage difference $V_{eb_a}$ of the transistor Qa is CTAT, the branch current Ib2 is a CTAT current.

In the specification, it is assumed that the transistor size of the transistor Qb is equivalent to N times of the transistor size of the transistor Qa. Therefore, the saturation current Isb of the transistor Qb and the saturation current Isa of the transistor Qa have the following relationship Isb=N*Isa.

In FIG. 2, a voltage difference ΔV can be considered as a difference between the emitter-base voltage differences $V_{eb_a}$ and $V_{eb_b}$ Together with equations (2), (4), and the relationship between the saturation currents Isb=N*Isa, the voltage difference ΔV can be represented as equation (5).

$$\Delta V = V_{eb_a} - V_{eb_b} = V_T \cdot \ln(N) \quad \text{equation (5)}$$

The voltage difference ΔV can be considered a product of the branch resistor Rb1 and the branch current Ib1 (ΔV=Ib1*Rb1), and the branch current Ib1 can be represented by equation (6).

$$Ib1 = \frac{\Delta V}{Rb1} = \frac{V_T \cdot \ln(N)}{Rb1} \quad \text{equation (6)}$$

In equation (6), the voltage difference ΔV is proportional to absolute temperature (hereinafter, PTAT), and the branch current Ib1 is a PTAT current.

As the loading current Ib is equivalent to the summation of the branch currents Ib1, Ib2 (Ib=Ib1+Ib2), the loading current Ib includes a PTAT current (that is, Ib1) and a CTAT current (that is, Ib2).

The bandgap voltage Vbg can be considered as the voltage difference across the combination of the bandgap resistor R3. The bandgap voltage Vbg can thus be presented as the product of the bandgap current Ibg and the bandgap resistor R3 (that is, Vbg=Ibg*R3).

As the bandgap current Ibg, the loading current Ib, and the mirrored current Imir are equivalent (Ibg=Ib=Imir), the bandgap current Ibg can also be represented as the summation of the branch currents Ib1, Ib2 (Ibg=Ib1+Ib2). Accordingly, the bandgap voltage Vbg is generated by the summation of the two branch currents Ib1 and Ib2, multiplied by the bandgap resistor R3. The bandgap voltage Vbg can be represented by equation (7).

$$Vbg = Ibg * R3 = Imir * R3 = Ib * R3 = (Ib1 + Ib2) * R3 = \left[\frac{V_T \cdot \ln(N)}{Rb1} + \frac{V_{eb_a}}{Ra}\right] * R3 \quad \text{equation (7)}$$

Consequentially, by choosing appropriate resistance values for the branch resistors Rb1, Rb2, and the bandgap resistor R3, a predefined value of the bandgap voltage Vbg, independent of temperature variation and equivalent to a scales sum of CTAT and PTAT voltages, can be obtained. As long as the bandgap voltage Vbg is precisely maintained at the predefined value, the precision of the reference voltage Vref can be guaranteed.

The bandgap module 21 can be a dominant noise contributor. To keep the noise low, the lowpass filter 213 is employed to lower the noise without a power penalty. The lowpass filter 213 includes a loading resistor Rld and a loading capacitor Cld, and both are electrically connected to the reference terminal Nref.

The loading resistor Rld is electrically connected to the bandgap terminal Nbg, and the loading capacitor Cld is electrically connected to the ground terminal Gnd. The loading resistor Rld conducts the bandgap voltage Vbg to the reference terminal Nref, and the loading capacitor Cld stabilizes the reference voltage Vref and filters out the noise in the bandgap voltage Vbg.

In FIG. 2, the use of the lowpass filter 213 might severely affect the start-up time, and the IoT device's response time increases. Another embodiment capable of using the noise filter function of the lowpass filter 213 and reducing the side effects of the lowpass filter 213 is provided.

Figure 3:
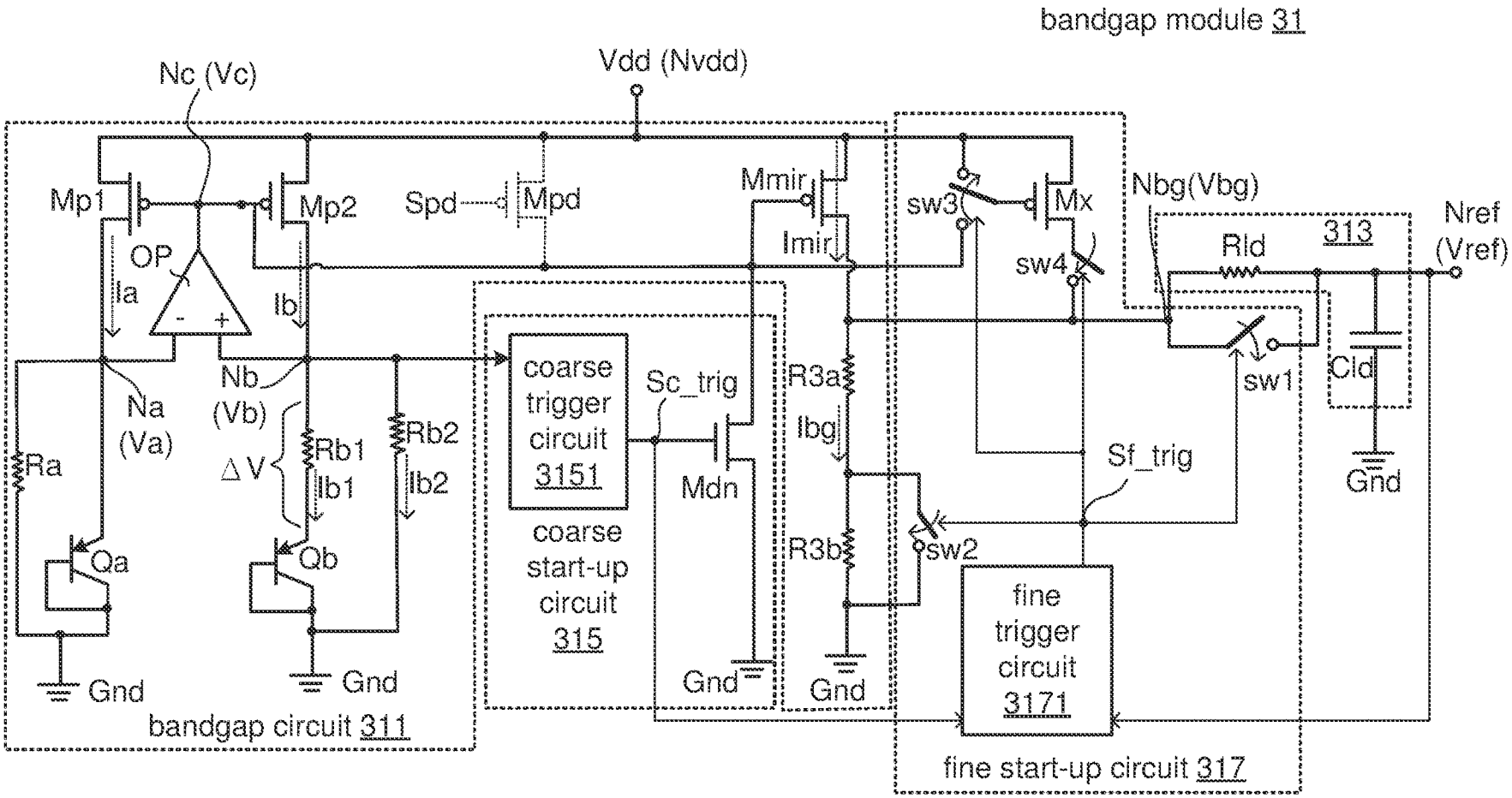
FIG. 3 is a schematic diagram illustrating an implementation of the bandgap module according to another embodiment of the present disclosure.

FIG. 3 is a schematic diagram illustrating an implementation of the bandgap module according to another embodiment of the present disclosure. The bandgap module 311 includes a bandgap circuit 311, a lowpass filter 313, a coarse start-up circuit 315, and a fine start-up circuit 317. The start-up procedure of the bandgap module 311 includes two phases, a coarse phase (PH1) and a fine phase (PH2). The coarse start-up circuit 315 operates in the coarse phase (PH1), and the fine start-up circuit 317 operates in the fine phase (PH2).

The bandgap circuit 311 and the lowpass filter 313 are similar to those in FIG. 2, except that the bandgap branch in FIG. 2 includes only one bandgap resistor R3, but the bandgap branch in FIG. 3 includes two bandgap resistors R3*a*, R3*b*. Thus, details about the operations of the bandgap circuit 311 and the lowpass filter 313 are omitted. The resistance value of the bandgap branch is represented as Rbg. In short, the bandgap branch in FIG. 3 dynamically changes its resistance value Rbg in different phases.

The coarse start-up circuit 315 includes a coarse trigger circuit 3151 and a pull-down transistor Mdn. In the specification, it is assumed that the pull-down transistor Mdn is an NMOS transistor, and the coarse trigger circuit 3151 generates a coarse trigger signal Sc_trig to enable/disable the pull-down transistor Mdn. Whereas, in practical applications, the pull-down transistor Mdn can be a PMOS, and the design of the coarse trigger circuit 3151 may vary.

The coarse trigger circuit 3151 is electrically connected to the terminal Nb and the gate terminal of the pull-down transistor Mdn. The drain terminal and the source terminal of the pull-down transistor Mdn are respectively electrically connected to the current control terminal Nc and the ground terminal Gnd.

The coarse trigger signal Sc_trig is generated in response to the terminal voltage Vb. The coarse trigger signal Sc_trig switches on the pull-down transistor Mdn, so the gate terminal of the mirror transistor Mmir can be quickly dropped to the ground voltage Gnd. Thus, the mirror transistor Mmir is switched on faster, and the mirrored current Imir can be increased instantaneously.

Whenever the terminal voltage Vb is lower than a predefined threshold voltage Vth1, the coarse trigger circuit 3151 generates the coarse trigger signal Sc_trig to switch on the pull-down transistor Mdn. Consequentially, the current control voltage Vc is conducted to the ground terminal Gnd and the loading transistors Mp1, MP2 are completely switched on. Then, a larger terminal current Ia flows through the loading transistor Mp1, and a greater loading current Ib flows through the loading transistor Mp2.

When the electronic device switches from the power-off state to the power-on state, or switches from the power saving mode to the normal operation mode, the signal at supply voltage terminal Nvdd needs to take some time to change from the ground voltage Gnd to the supply voltage Vdd. During the ramping up of the supply voltage terminal Nvdd, the terminal voltage Vb should continuously increase from 0V to the predefined value. However, when the power is just turned on, it is possible that there is no loading current Ia, Ib, or both, or the loading current Ib is not enough to bring up the terminal voltage Vb. In consequence, the increment of the bandgap voltage Vbg is very slow. Thus, the coarse trigger circuit 3151*a* helps to inject current to the terminal voltage Va and the terminal voltage Vb to assist in quickly starting up the bandgap voltage Vbg.

According to the embodiment of the present disclosure, the coarse trigger circuit 3151 directly detects one of the terminal voltages Va, Vb and generates the coarse trigger signal Sc_trig in response. For the sake of illustration, detection of the terminal voltage Vb is described as an example. As long as the terminal voltage Vb is still below the threshold voltage Vth1 (Vb<Vth1), the coarse trigger circuit 3151*a* determines that the bandgap voltage Vbg is still not high enough and pulls up the coarse trigger signal Sc_trig to switch on the pull-down transistor Mdn. Once the pull-down transistor Mdn is switched on, the current control voltage Vc is pulled down, and currents conducted by the loading transistors Mp1, Mp2 become greater. Consequentially, the currents being injected to the terminals Na, Nb are increased, and the terminal voltages Va, Vb are increased accordingly.

With the gradual increment of the terminal voltage Vb, the coarse trigger circuit 3151*a* confirms that the relationship (Vb≥Vth1) becomes satisfied. Under such circumstances, the coarse trigger circuit 3151 generates the coarse trigger signal Sc_trig to switch off the pull-down transistor Mdn and to inform the fine trigger circuit 3171 to start to compare the reference voltage Vref with the threshold voltage Vth2. Then, the pull-down transistor Mdn stops affecting the current control voltage Vc, and the fine trigger circuit 3171 starts to operate.

The fine start-up circuit 317 includes a fine trigger circuit 3171 and switches sw1, sw2, sw3, sw4. The switch sw3 is a two-way switch. The common terminal of the switch sw3 is electrically connected to the gate terminal of the additional transistor Mx, and the switch terminals of the switch sw3 are respectively electrically connected to the voltage supply terminal Nvdd and the current control terminal Nc.

The fine trigger circuit 3171 receives the coarse trigger signal Sc_trig from the coarse trigger circuit 3151 and receives the reference voltage Vref from the lowpass filter 313. Based on the coarse trigger signal Sc_trig and the reference voltage Vref, the fine trigger circuit 3171 generates the fine trigger signal Sf_trig.

The switches sw1, sw2, sw3, sw4 are controlled by the fine trigger signal Sf_trig. For the sake of comparison, the relationships between the conduction states of switches sw1, sw2, sw3, sw4, and the fine trigger signal Sf_trig are summarized in Table 1. Details about how the logic level of the fine trigger signal Sf_trig is determined and its subsequent operations of the switches sw1, sw2, sw3, sw4 are described later.

TABLE 1

| | fine trigger signal | sw1 | sw2 | sw3 | sw4 |
|---|---|---|---|---|---|
| coarse phase (PH1) | Sf_trig = L | OFF | OFF | connect gate terminal of Mx to Nvdd | OFF |
| fine phase (PH2) | Sf_trig = H | ON | ON | connect gate terminal of Mx to Nc | ON |

When the fine trigger signal Sf_trig is set to the logic high (Sf_trig=H), the switches sw1, sw2, sw4 are switched on, and the switch sw3 connects the gate terminal of the additional transistor Mx to the current control terminal Nc. When the fine trigger signal Sf_trig is set to the logic low (Sf_trig=L), the switches sw1, sw2, sw4 are switched off, and the switch sw3 connects the gate terminal of the additional transistor Mx to the supply voltage terminal Nvdd.

The switch sw4 is electrically connected to the drain terminal of the additional transistor Mx and the bandgap terminal Nbg. Thus, the switch sw4 selectively conducts the bandgap voltage Vbg to the drain terminal of the additional transistor Mx.

The bandgap resistor R3*b* and the switch sw2 are connected in parallel. Thus, when the switch sw2 is switched on, a bandgap current Ibg flows through only the bandgap resistor R3 and the switch sw2, not through the bandgap resistor R3*b*.

Once the fine trigger circuit 3171 receives the coarse trigger signal Sc_trig representing that the terminal Vb is greater than or equivalent to the threshold voltage Vth1 (Vb≥Vth1), and the fine trigger circuit 3171 confirms that the reference voltage Vref is lower than the threshold voltage Vth2 (Vref<Vth2), the fine trigger circuit 3171 sets the fine trigger signal Sf_trig to the logic high (Sf_trig=H). Otherwise, the fine trigger signal Sf_trig is set to the logic low (Sf_trig=L).

The selections of the threshold voltages Vth1, Vth2 are freely set by the designer and independent to each other. The threshold voltage Vth1 is set for the terminal Vb, and the threshold voltage Vth2 is set for the reference voltage Vref node. The threshold voltage Vth2 is dependent on filter size (RC values) as well.

The fine trigger circuit 3171 can be, for example, a NOR gate logic. Whereas the design and the implementation of the fine trigger circuit 3171 should not be limited.

The lowpass filter 313 includes a loading resistor Rld and a loading capacitor Cld, and both are electrically connected to the reference terminal Nref. The loading resistor Rld and the switch sw1 are connected in parallel. Thus, when the switch sw1 is switched on, the loading capacitor Cld is charged by the bandgap voltage Vbg through the switch sw1, not through the loading resistor Rld.

Figure 4A:
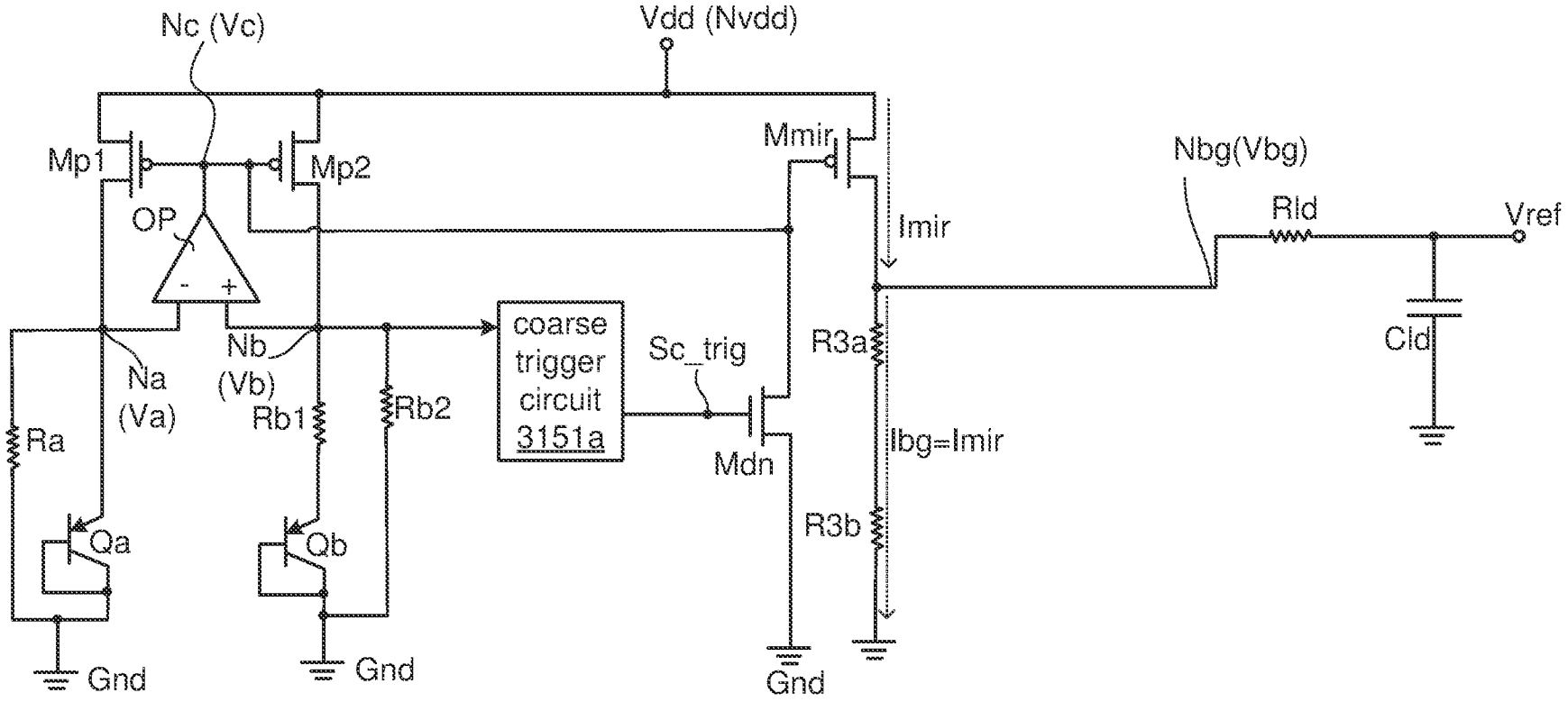
FIG. 4A is a schematic diagram illustrating the bandgap module operates in the coarse phase (PH1)
Figure 4B:
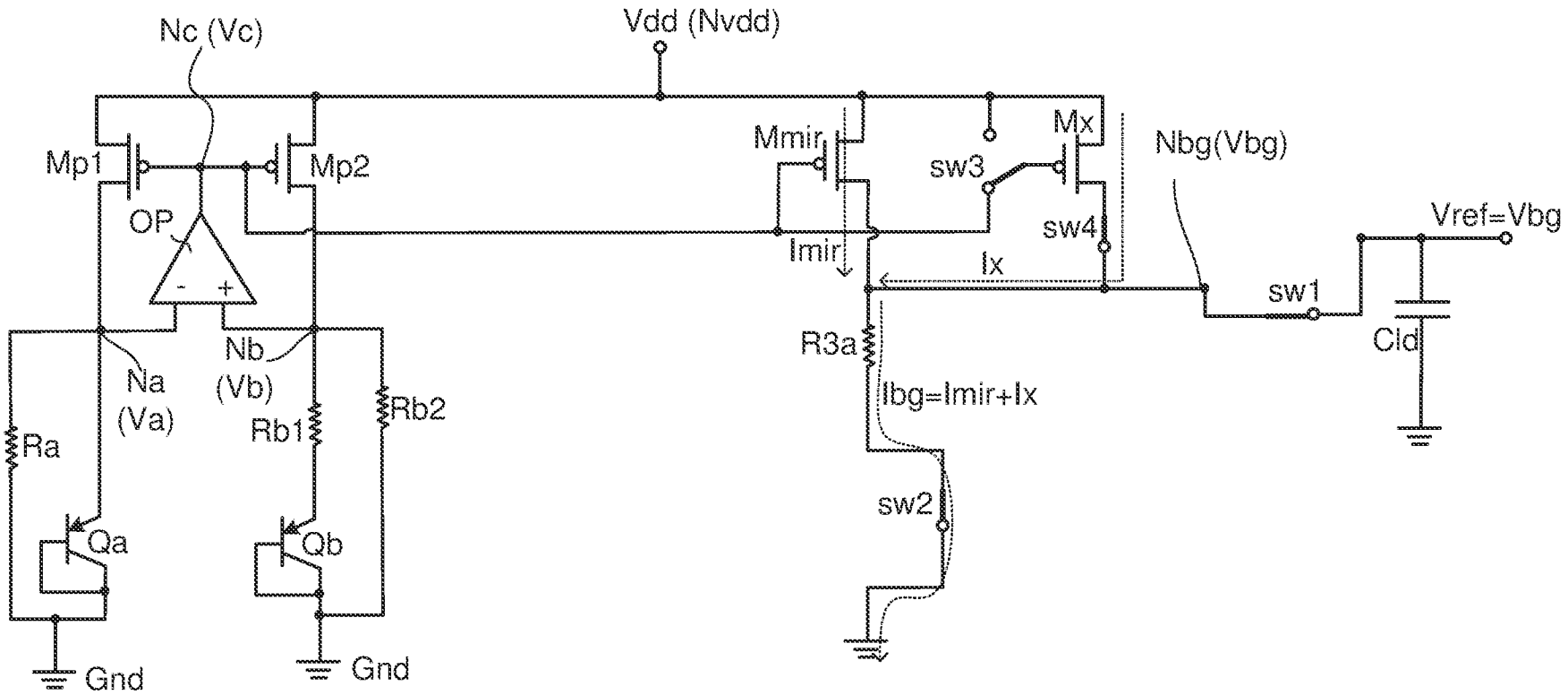
FIG. 4B is a schematic diagram illustrating the bandgap module operates in the fine phase (PH2)

FIGS. 4A and 4B are schematic diagrams illustrating the equivalent circuit of the bandgap module in the coarse phase (PH1) and the fine phase (PH2), respectively. The circuits in FIG. 3 which are not in operation during these durations are removed in FIGS. 4A and 4B.

Changes of the bandgap current Ibg, the bandgap voltage Vbg, and the resistance value of the bandgap branch in the coarse phase (PH1) and the fine phase (PH2) are compared in Table 2.

TABLE 2

| phase | Ibg | Vbg | resistance value of bandgap branch Rbg | Vbg = Ibg * Rbg |
|---|---|---|---|---|
| coars phase (PH1) | Ibg = Imir | Increased from OV to predefined value | Rbg = R3a + R3b | Vbg = Imir * (R3a + R3b) |
| fine phase (PH2) | Ibg = Imir + Ix | maintained at predefined value | Rbg = R3a | Vbg = (Imir + Ix) * R3a |

Please refer to FIGS. 3, 4A, and Table 2 together. When the bandgap module 31 operates in the coarse phase (PH1), the additional transistor Mx is switched off, and the bandgap current Ibg is equivalent to the mirrored current Imir (Ibg=Imir). Meanwhile, the bandgap voltage Vbg is continuously increased from the ground voltage Gnd to the predefined value. As the switch sw2 is switched off, the resistance value of the bandgap branch Rbg is equivalent to the summation of the bandgap resistors R3*a*, R3*b* (Rbg=R3*a*+R3*b*). Besides, the bandgap current Ibg flows through the bandgap resistors R3*a*, R3*b*.

Please refer to FIGS. 3, 4B, and Table 2 together. When the bandgap module 31 operates in the fine phase (PH2), the additional transistor Mx is switched on, and the bandgap current Ibg is equivalent to the summation of the mirrored current Imir and the additional current Ix (Ibg=Imr+Ix). As the switch sw2 is switched on, the resistance value of the bandgap branch Rbg is equivalent to the bandgap resistor R3*a* (Rbg=R3*a*). Besides, the bandgap current Ibg flows through the bandgap resistor R3*a* and the switch sw2, not the bandgap resistor R3*b*. Please note that the values of additional current Ix and bandgap resistor R3*a* are selected and set so that the product of the bandgap current Ibg and the bandgap resistor R3*a* is equivalent to the bandgap voltage Vbg. That is, Vbg=(Imr+Ix)*R3*a*. Thus, the bandgap voltage Vbg can be precisely maintained in the start-up procedure even if the bandgap current Ibg having a higher current value is injected during the fine phase (PH2).

Please note that, in FIG. 4B, the additional transistor Mx and the mirror transistor Mmir jointly form a current mirror when the additional transistor Mx is switched on. Thus, the current values of the additional current Ix and the mirrored current Imir is dependent on the design (aspect ratio) of the additional transistor Mx and the mirror transistor Mmir.

Assuming that the additional current Ix is equivalent to the mirrored current Imir in the fine phase (PH2), the bandgap current Ibg in the fine phase (PH2) will be equivalent to two times of the bandgap current Ibg in the coarse phase (PH1). Based on the equivalences of the bandgap current Ibg (Ibg=Imir in the coarse phase (PH1), and Ibg=Imir+Ix=2*Imir in the fine phase (PH2)), and the feature that the bandgap voltage Vbg remains constant by the end of the coarse phase (PH1) and during the fine phase (PH2), it can be further concluded that the resistance values of the bandgap resistors R3*a*, R3*b* are equivalent. That is, R3*a*=R3*b* because Vbg=Ibg*Rbg=Imir*(R3*a*+R3*b*)=(Imir+Ix)*R3*a*=2*Imir*R3*a*.

The electronic device might proceed with a start-up procedure in different scenarios, for example, in a scenario where the electronic device is switched from a power-off state to a power-on state, or in a scenario where the electronic device switches from a power-saving state (for example, a power-down mode or a sleep mode) to an active state (for example, a normal operation mode).

Figure 5:
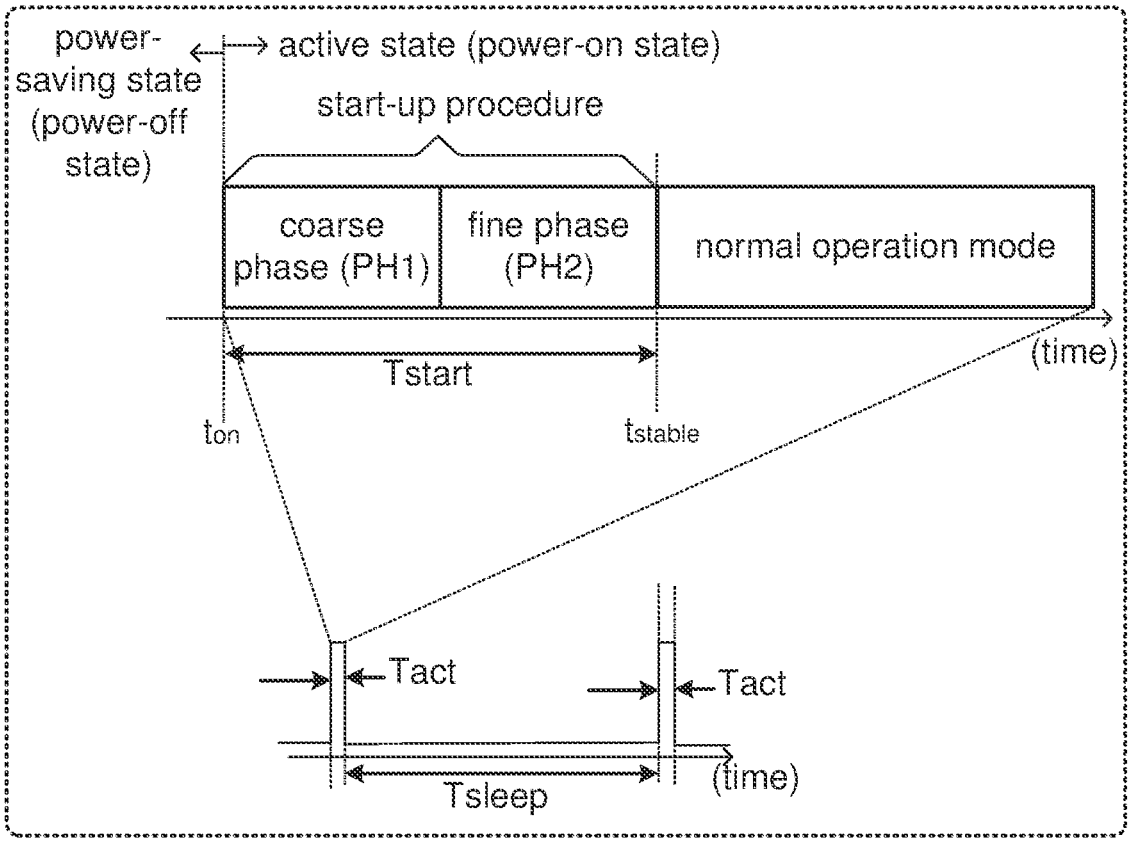
FIG. 5 is a schematic diagram illustrating that the design of the bandgap module, according to the embodiment of the present disclosure, is suitable for the state transition of an always-on battery-powered electronic device.

FIG. 5 is a schematic diagram illustrating that the design of the bandgap module, according to the embodiment of the present disclosure, is suitable for the state transition of an always-on battery-powered electronic device.

The always-on battery-powered electronic device stays in the power-saving state most of the time (sleep duration Tsleep), but occasionally needs to wake up for a short period (active duration Tact). When the electronic device switches to be active, a start-up procedure is required before the electronic device actually enters the normal operation mode.

Before a power-on time point $t_{on}$, the electronic device is in a power-saving state (or a power-off state). After the power-on time point $t_{on}$, the electronic device starts its start-up procedure. The duration of the start-up procedure is defined as a start-up duration Tstart. By the end of the start-up procedure, the electronic device enters the normal operation mode at the stable time point $t_{stable}$.

The bandgap module 31, according to the embodiment of the present disclosure, shortens the start-up duration Tstart by separating the start-up procedure into a coarse phase (PH1) and a fine phase (PH2). In the coarse phase (PH1), the bandgap voltage (Vbg) is quickly increased up to the predefined value, but the increasing speed of the reference voltage Vref is dragged by the lowpass filter 313. In the fine phase (PH2), the bandgap voltage (Vbg) is maintained at the predefined value, and the reference voltage (Vref) is quickly increased through the conduction of the switch sw1.

The embodiment in FIG. 2 meets the requirement of low quiescent current and low noise. In addition, the embodiment in FIG. 3 further incorporates the coarse start-up circuit and the fine start-up circuit to shorten the start-up duration Tstart. Therefore, the bandgap module and the linear regulator, according to the embodiment of the present disclosure, meet the performance metrics, including low quiescent current, low noise, and fast start-up.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A bandgap module, comprising:

a bandgap circuit, comprising:

an operational amplifier, comprising a first input terminal, a second input terminal, and a current control terminal;

a current mirror, electrically connected to the first input terminal, the second input terminal, and the current control terminal, configured to generate a first loading current, a second loading current, and a mirrored current, wherein the first loading current, the second loading current, and the mirrored current are generated based on a signal at the current control terminal, and the first loading current, the second loading current, and the mirrored current are equivalent;

a first loading branch, electrically connected to the first input terminal, configured to receive the first loading current;

a second loading branch, electrically connected to the second input terminal, configured to receive the second loading current; and a bandgap branch, electrically connected to the current mirror, configured to receive the mirrored current and conduct a bandgap current, wherein a bandgap voltage is generated based on the bandgap current;

a start-up module, comprising:

a first start-up circuit, electrically connected to the bandgap circuit, configured to accelerate generation of the mirrored current so that the bandgap voltage is increased to a predefined value when the bandgap module operates in a first phase; and a second start-up circuit, electrically connected to the bandgap circuit, the lowpass filter, and the first start-up circuit, configured to conduct an additional current to the bandgap branch and maintain the bandgap voltage at the predefined value when the bandgap module operates in a second phase, wherein the second phase is after the first phase; and a lowpass filter, electrically connected to the bandgap circuit and the second start-up circuit, configured to filter noise of the bandgap voltage and generate a reference voltage accordingly.

2. The bandgap module according to claim 1, wherein the first start-up circuit triggers the bandgap module to operate in the first phase if a signal at the second input terminal is lower than a first threshold voltage, and the second start-up circuit triggers the bandgap module to operate in the second phase if the first start-up circuit suspends operation and the reference voltage is lower than a second threshold voltage.

3. The bandgap module according to claim 1, wherein the bandgap current is equivalent to the mirrored current when the bandgap module operates in the first phase, and the bandgap current is equivalent to a summation of the mirrored current and the additional current when the bandgap module operates in the second phase.

4. The bandgap module according to claim 1, wherein the current mirror comprises:

a first loading transistor, electrically connected to the supply voltage terminal, the current control terminal, and the first input terminal, configured to selectively generate the first loading current based on the signal at the current control terminal;

a second loading transistor, electrically connected to the supply voltage terminal, the current control terminal, and the second input terminal, configured to selectively generate the second loading current based on the signal at the current control terminal; and a mirror transistor, electrically connected to the supply voltage terminal, the current control terminal, and the bandgap terminal, configured to selectively generate the mirrored current based on the signal at the current control terminal.

5. The bandgap module according to claim 1, wherein the first start-up circuit comprises:

a first trigger circuit, electrically connected to the second input terminal, configured to generate a first trigger signal based on a comparison between a signal at the second input terminal and the first threshold voltage; and a pull-down transistor, electrically connected to the first trigger circuit and the current control terminal, configured to be selectively switched on based on the first trigger signal, wherein the signal at the current control terminal is changed with conduction of the pull-down transistor.

6. The bandgap module according to claim 5, wherein the pull-down transistor is switched on when the bandgap module operates in the first phase, and the pull-down transistor is switched off when the bandgap module operates in the second phase.

7. The bandgap module according to claim 1, wherein the second start-up circuit comprises:

a second trigger circuit, configured to receive the first trigger signal and the reference voltage and generate a second trigger signal in response;

a plurality of switches, electrically connected to the second trigger circuit, configured to be selectively switched based on the second trigger signal; and an additional transistor, electrically connected to a first switch and a second switch among the plurality of switches, configured to selectively generate the additional current based on conduction statuses of the first switch and the second switch.

8. The bandgap module according to claim 7, wherein the bandgap branch comprises:

a first bandgap resistor, electrically connected to the bandgap terminal and a terminal of a third switch among the plurality of switches; and a second bandgap resistor, electrically connected to the third switch in parallel, wherein the third switch is switched off and the bandgap branch has a first resistance value when the bandgap module operates in the first phase, and the third switch is switched on and the bandgap branch has a second resistance value when the bandgap module operates in the second phase, wherein the first resistance value is greater than the second resistance value.

9. The bandgap module according to claim 8, wherein when the bandgap module operates in the first phase, the bandgap voltage is equivalent to a product of the bandgap current times the first resistance value, and when the bandgap module operates in the second phase, the bandgap voltage is equivalent to a product of the bandgap current times the second resistance value.

10. The bandgap module according to claim 8, wherein the first resistance value is equivalent to a summation of the first bandgap resistor and the second bandgap resistor, and the second resistance value is equivalent to the first bandgap resistor.

11. The bandgap module according to claim 7, wherein the lowpass filter comprises:

a loading resistor, electrically connected to the bandgap terminal and a reference terminal of the bandgap module, wherein the reference voltage is generated at the reference terminal; and a loading capacitor, electrically connected to the reference terminal and the ground terminal, wherein a fourth switch among the plurality of switches is electrically connected to the loading resistor in parallel.

12. The bandgap module according to claim 11, wherein when the bandgap module operates in the first phase, the fourth switch is switched off, and the loading resistor conducts the bandgap voltage to the reference terminal; and when the bandgap module operates in the second phase, the fourth switch is switched on, and the fourth switch directly conducts the bandgap voltage to the reference terminal.

13. The bandgap module according to claim 7, wherein the first switch is a two-way switch comprising a common terminal, a first switch terminal, and a second switch terminal, wherein the common terminal is electrically connected to a gate terminal of the additional transistor, the first switch terminal is electrically connected to the supply voltage terminal, and the second switch terminal is electrically connected to the current control terminal.

14. The bandgap module according to claim 13, wherein the second switch is electrically connected to the bandgap terminal and a drain terminal of the additional transistor.

15. The bandgap module according to claim 14, wherein when the bandgap module operates in the first phase, the first switch conducts the supply voltage to the gate terminal of the additional transistor, and the second switch disconnects the drain terminal of the additional transistor and the bandgap terminal.

16. The bandgap module according to claim 14, wherein when the bandgap module operates in the second phase, the first switch connects the current control terminal to the gate terminal of the additional transistor, and the second switch connects the drain terminal of the additional transistor to the bandgap terminal.

17. The bandgap module according to claim 1, wherein the additional current is equivalent to the mirrored current.

18. The bandgap module according to claim 1, wherein the bandgap circuit further comprises:

a power-down transistor, electrically connected to the bandgap circuit, configured to be selectively switched on based on a power-down signal, wherein the bandgap module is disabled when the power-down transistor is switched on.

19. The bandgap module according to claim 1, wherein the bandgap voltage is temperature independent.

20. A linear regulator, configured to receive a supply voltage, comprising:

a bandgap module, comprising:

a bandgap circuit, configured to generate a bandgap voltage, comprising:

an operational amplifier, comprising a first input terminal, a second input terminal, and a current control terminal;

a current mirror, electrically connected to the first input terminal, the second input terminal, and the current control terminal, configured to generate a first loading current, a second loading current, and a mirrored current, wherein the first loading current, the second loading current, and the mirrored current are generated based on a signal at the current control terminal, and the first loading current, the second loading current, and the mirrored current are equivalent;

a first loading branch, electrically connected to the first input terminal, configured to receive the first loading current;

a second loading branch, electrically connected to the second input terminal, configured to receive the second loading current; and a bandgap branch, electrically connected to the current mirror, configured to receive the mirrored current and conduct a bandgap current, wherein a bandgap voltage is generated based on the bandgap current;

a start-up module, comprising:

a first start-up circuit, electrically connected to the bandgap circuit, configured to accelerate generation of the mirrored current so that the bandgap voltage is increased to a predefined value when the bandgap module operates in a first phase; and a second start-up circuit, electrically connected to the bandgap circuit, the lowpass filter, and the first start-up circuit, configured to conduct an additional current to the bandgap branch and maintain the bandgap voltage at the predefined value when the bandgap module operates in a second phase wherein the second phase is after the first phase; and a lowpass filter, electrically connected to the bandgap circuit and the second start-up circuit, configured to filter noise of the bandgap voltage and generate a reference voltage accordingly; and an error amplifier, electrically connected to the bandgap module, configured to generate an error signal by comparing the reference voltage with a comparison voltage, wherein a regulated voltage is generated based on the supply voltage and the error signal.

* * * * *